United States Patent [19]

Lower et al.

[11] 4,234,416

[45] Nov. 18, 1980

[54] FEED STREAM SPLITTER FOR MULTIPLE DECK SCREENING MACHINE

[75] Inventors: William E. Lower, Cincinnati; Stephen C. Mitchell, West Chester; Jeremy F. Simpson, Cincinnati, all of Ohio

[73] Assignee: Rotex, Inc., Cincinnati, Ohio

[21] Appl. No.: 68,908

[22] Filed: Aug. 23, 1979

[51] Int. Cl.[3] ..... B07B 1/28

[52] U.S. Cl. ..... 209/247; 209/254; 209/315

[58] Field of Search ..... 209/241, 243, 247, 253, 209/254, 315, 355, 356, 370

[56] References Cited

U.S. PATENT DOCUMENTS

| | | | |
|---|---|---|---|
| 852,050 | 4/1907 | Barbeau | 209/243 X |
| 1,056,388 | 3/1913 | Wilfley | 209/437 X |
| 1,097,113 | 5/1914 | Wilflex | 209/437 X |
| 1,918,398 | 7/1933 | Johnson | 209/254 X |
| 2,683,533 | 7/1954 | Paul | 209/315 X |

*Primary Examiner*—William A. Cuchlinski, Jr.
*Attorney, Agent, or Firm*—Wood, Herron & Evans

[57] ABSTRACT

In a multiple deck screening machine, the feed material is divided into separate equal fractions as it falls into parallel vertical channels. Each channel serves a particular screen deck via a chute which diverts the respective fraction from the channel onto the screen. The lower chutes include widened portions that extend laterally from their respective channels into areas which are masked or closed above by overlying upper chutes, in order to provide flow areas onto the respective screens which are wider than the channels that feed them, and thereby provide better flow distribution onto the screens.

11 Claims, 7 Drawing Figures

FEED STREAM SPLITTER FOR MULTIPLE DECK SCREENING MACHINE

FIELD OF THE INVENTION

This invention relates to screening machines of the type wherein the material to be screened is divided or split into separate fractions which are then directed to several screens in parallel flow paths. More particularly, it relates to improved structure for splitting the feed stream into separate fractions and for spreading the fractions onto the respective screens.

BACKGROUND OF THE INVENTION

In many commercial applications particulate materials may be screened at very high rates of throughput. In the grain industry, for example, screeners handle grain throughputs as large as 40,000 bushels per hour or even more. Because a screen of given type and area will have an optimal operating rate above which it does not screen as efficiently, higher rates generally require larger screen areas. In order to handle a high flow rate while minimizing the floor area of the machine, it has been the practice for many years to provide the needed area among a plurality of screens or "decks" arranged one above another as a stack, and to divide the material to be screened into several fractions for separate screening on the respective screens. After the fines in each fraction have been separated on the respective screen, the product fractions are recombined.

In order to most effectively utilize each screen of such a stack or "bank", it is important to divide the input stream into essentially equal fractions of uniform flow rate, to feed the respective screens equally so that no screen is underfed and none is overfed. At the same time it is important that the fractions be fed onto the respective screens in a manner which rapidly distributes the material over the screen area, so that all of the area will be used at an effective rate.

This invention is aimed at providing a feed splitter or distributor for a multiple deck screener which at any flow rate will more accurately divide the feed stream into separate substantially equal fractions and distribute those fractions onto the respective screens in a manner to use the area of each screen more effectively.

The Prior Art

Barbeau U.S. Pat. No. 852,050 shows a two deck screener wherein the feed, falling as a stream, is divided into two parts as it is intersected by staggered or offset upper and lower chutes which extend into the path of the falling stream, and divert fractions onto the separate screens. The lower chutes divert the grain which falls through the spaces between the upper chutes. Paul U.S. Pat. No. 2,683,533 shows a similar arrangement. Wilfley U.S. Pat. No. 1,056,388 teaches feeding multiple screens from an overhead trough having openings in its bottom which feed the respective screens through vertical separate flow channels. Wilfley U.S. Pat. No. 1,097,113 is similar.

In prior art devices as shown in Barbeau wherein the screen is operated in a vibratory or generally reciprocating motion, the motion of the chutes which split the feed stream is roughly perpendicular to the general plane of the curtain of falling grain, as distinguished from lateral movement within that plane. Such motion of the chutes does not seriously affect the accuracy of the fractionation; that is, the reciprocating motion does not of itself change the proportion that is intercepted by the chutes. However, where the screening motion is of a gyratory type which involves a circular or orbital screen motion in a horizontal plane, the chute moves laterally in the falling material. This tends to deflect grain off the sides of the chutes. Such deflection irregularly changes the path of the falling grain, with the result that the fractions which are received by some chutes may not correspond to their width and the feed is unevenly fractionated. This invention is particularly aimed at structure for splitting a falling curtain of particulate material in such manner that even in a screener of the gyratory type the respective screens will be uniformly supplied.

Apart from the nonuniformity of fractionation, the fraction fed onto the screen from the chute has in the past been poorly distributed onto the screen, with overloading at the chute discharge area. This has tended to reduce screening efficiency. In past screeners the width of each chute has been relatively small in relation to the width of the screen. The (one or several) chutes for each deck have had a total width, in proportion to the screen width, equal to the reciprocal of the number of decks. For example, the chutes feeding one screen of a five deck machine total 1/5 the width of the screen, so as to intercept that fraction of the grain. The narrow width of the chute in relation to the screen which it feeds has led to poor distribution because the mass of material enters the screen through the relatively narrow "window" that is defined by the chute width. This tends to overload the screen adjacent the chute discharge area, and to undercharge or starve the adjacent areas at the upstream end of the screen, on either side of the chute. The screen area is thus fed unevenly, and this tends to reduce the effective screening capacity of each screen in the deck, regardless of the accuracy of feed splitting. This invention is further aimed at feeding each screen more uniformly by providing wider chutes, but without increasing the overall width of the screen or the machine.

BRIEF DESCRIPTION OF THE INVENTION

In the screener of this invention the particulate material to be screened falls over the edge of a sloping, overlying distributor panel, falling as a uniform curtain across the length of that edge. It is divided as it falls, before being diverted onto the screens. The falling curtain of particles is divided into equal fractions by a series of thin, parallel, vertically extending sheet-like flow dividers positioned in its path. The curtain of material to be screened drops into the open upper ends of these channels and is thereby split into separate fractions that remain confined in the channels between the respective dividers. Each channel leads downwardly to a separate chute that diverts the respective fraction from the channel onto a screen. The lower chutes are widened by lateral projection, in the plane of the curtain, beyond the width of their respective channels, extending into the dead space below overlying upper chutes. This has been found to improve screening efficiency in that flow onto the screen from the respective channel occurs through a wider "windown". In the preferred embodiment of the invention all of the chutes, save the uppermost and lowermost chutes, have widths which are equal to twice the width of the uppermost channels, each lower channel being masked by an overlying channel. The lowermost chute extends the full width of the screen deck, being masked by the other chutes which are all above it. The feed falling into the lowermost chute is discharged onto the lowermost screen across the full screen width.

BRIEF DESCRIPTION OF THE DRAWINGS

The invention can best be further described and explained by reference to the accompanying drawings, in which.

The distributor is useful in connection with multiple deck screeners having two or more screens. In the embodiment shown, it is illustrated in connection with a very large capacity machine having four banks of screens, each bank having five separate screens, with the banks being arranged opposite to one another in two side-by-side pairs and discharging to common product and fines delivery chutes.

Figure 1:
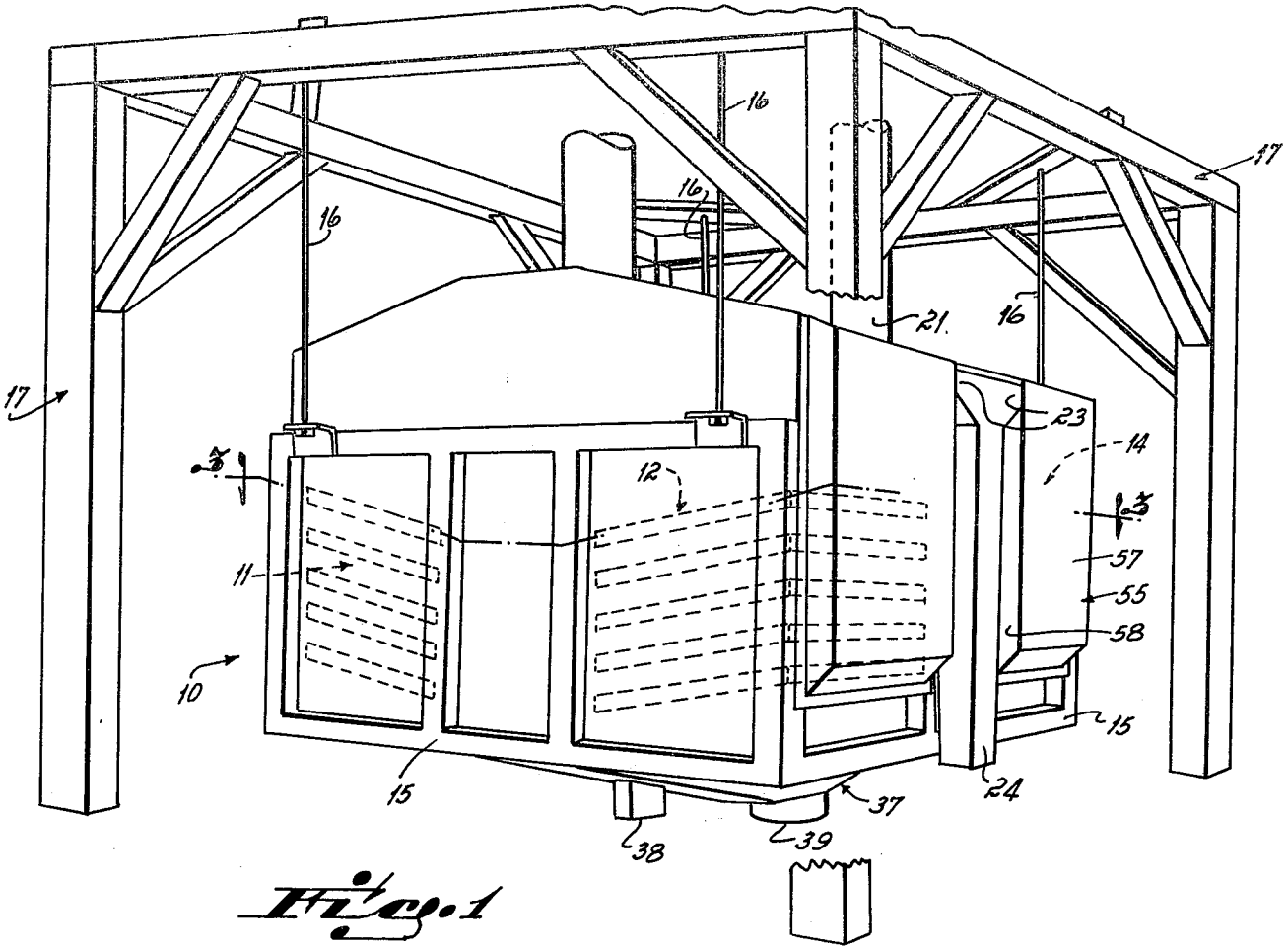
FIG. 1 is a perspective view, somewhat diagrammatic in nature, of a screening machine wherein four similar feed splitters, each in accordance with a preferred embodiment of the invention, are utilized to feed four banks of screens, with each bank having five screen decks.

More particularly, the screening machine designated generally at 10 in the drawings includes four banks of screens designated at 11, 12, 13 and 14 respectively (see FIG. 3) which are mounted in a unitary generally rectangular frame 15. Machine 10 is free-floating and is suspended at its four corners from a supporting stand 17 (FIG. 1) as by cables 16, to minimize forces transmitted to the stand.

Screener 10 is driven in a gyratory screening movement by drive mechanism D which may be conventional and which is mounted by frame 15. Reference may be had to Lower U.S. Pat. No. 3,819,050, assigned to the same assignee as this application, for further disclosure of a suitable drive. The gyratory type of motion is especially desirable for high rate machines because the horizontal motion rapidly distributes the grain over the entire width of the screens with little vertical vibration or hop, so that there is little churning or remixing of fines. This quickly achieves stratification of fines and promotes fast passage through the screen openings.

Figure 2:
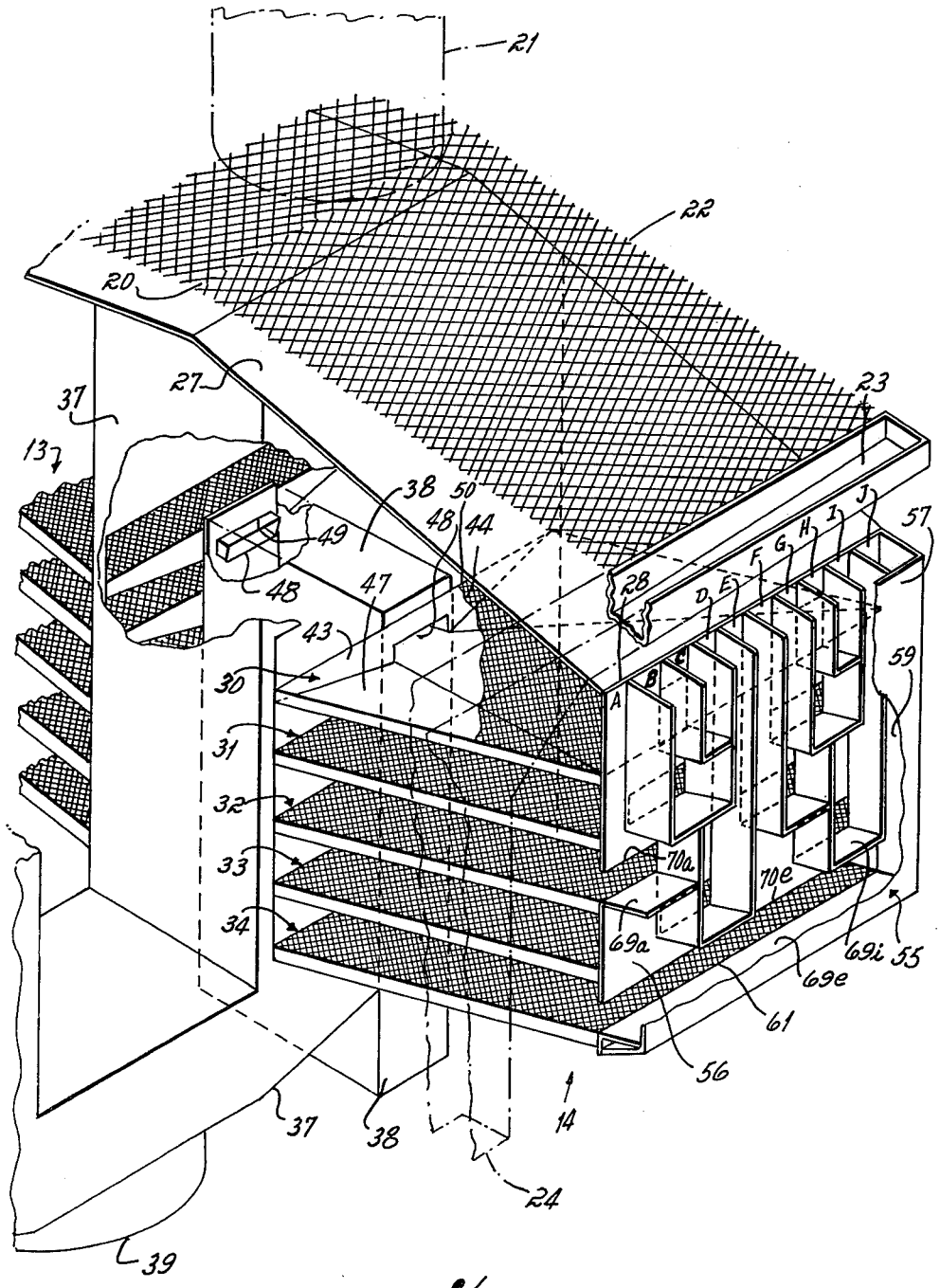
FIG. 2 is a diagrammatic perspective showing a portion of the machine of FIG. 1, broken away to show a single bank of screens and the feed distributor which feeds that bank.
Figure 3:
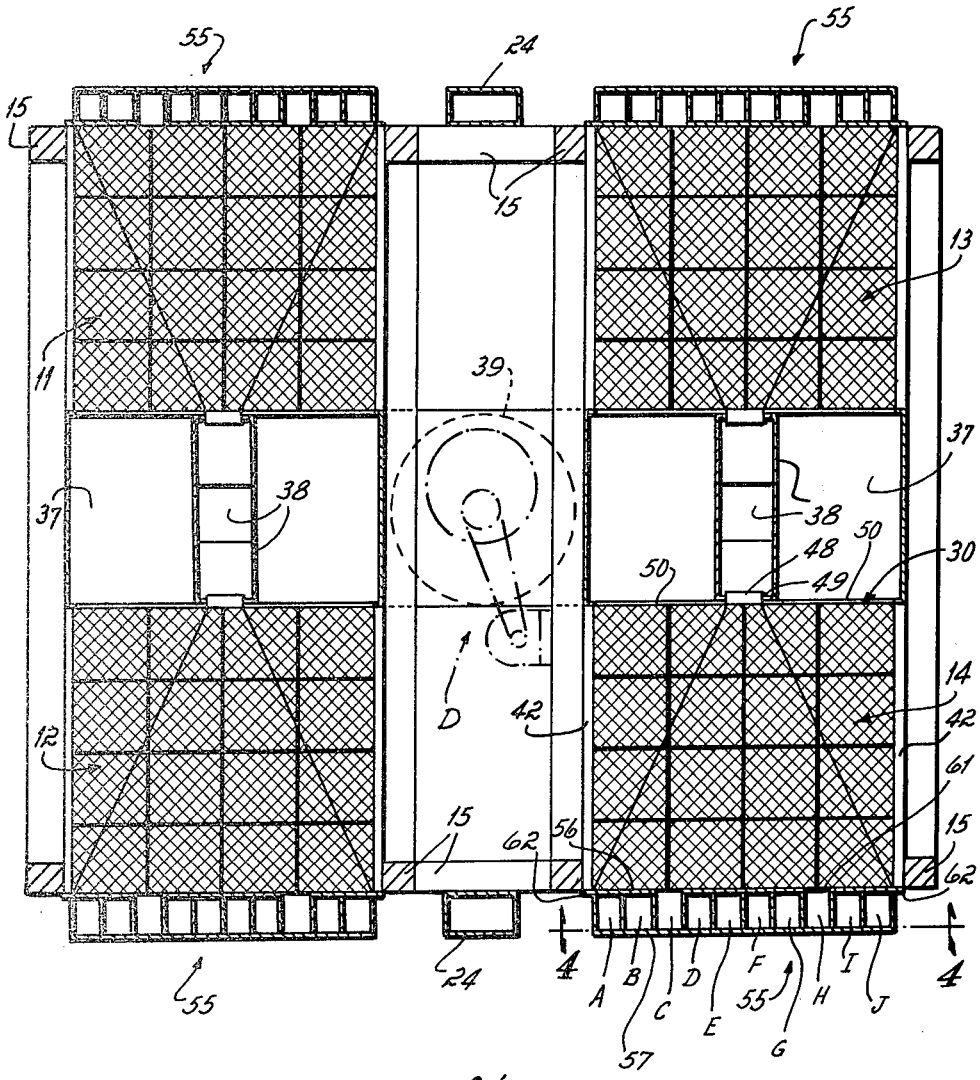
FIG. 3 is a horizontal section taken on line 3—3 of FIG. 1.

In machine 10 the four banks of screens are arranged in side-by-side pairs, the banks of each pair being opposed to one another. As shown in FIG. 3, opposed banks 11 and 12 present screens which are angulated downwardly toward the center. Banks 13 and 14 are similarly arranged beside the first pair of banks. The two pairs of banks may be fed by separate overhead inlet chutes, one of which, shown at 21 in FIG. 2, feeds banks 13 and 14 and the other of which is similar and feeds the other pairs of banks 11 and 12.

The incoming material from chute 21 falls on a central apex or peak 20 over the two banks, which in effect splits the feed into two separate streams to the two banks. In the illustrated embodiment the flow to each bank from apex 20 is first onto a downwardly and outwardly sloping scalping screen, one of which is shown at 22 in FIG. 2. This screen (which is optional) removes coarse or overside particles. The overside material remains on screen 22 and drops into an overs trough shown at 23 in FIG. 2, which is slanted in a direction to chute the overs to a takeoff chute 24 between banks 12 and 14. (The other side of the machine is symmetrical, and thus is not described.)

The balance of the feed, including the product and the fines which are to be separated from it, falls through scalping screen 22 onto a downwardly and outwardly slanting distribution panel 27, over which it fans out (under the influence of the screening motion) across the entire width of the panel to a lower edge 28 which lies above the outboard ends of the screens of the respective bank 14.

In each bank the screens are arranged in alignment, in the form of a vertical stack. In the embodiment shown, bank 14 includes five screens in the form of "decks" or "drawers" designated 30, 31, 32, 33 and 34. The material to be screened flows in parallel over these screens from the outboard ends to the inner ends. The screens in the bank lie parallel to one another and slope downwardly and inwardly toward the region between banks 13 and 14, where over-the-screen product material is delivered into a product chute 37 and the through-the-screen fines are delivered from a bottom pan directly into a fines chute 38. The product chutes from the four banks of screens are combined in the center of the machine to a common product delivery chute 39.

The several screens in each bank are slidable like drawers, in and out of frame 15. Each screen comprises an assembly or deck, one of which is shown at 30 in FIG. 5, which is slidable as a unit into or out of frame 15 on ways or guides 42, 42 (FIG. 3) when the distributor or feed splitter unit (to be described) has been removed from the frame.

Figure 5:
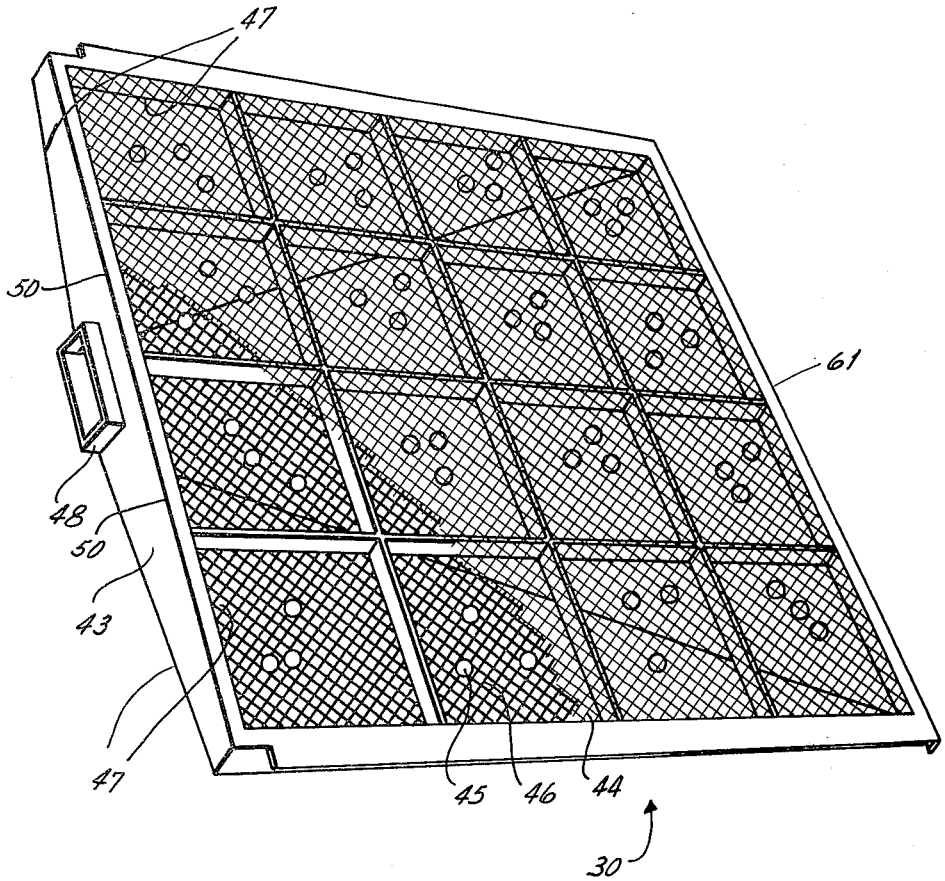
FIG. 5 is a perspective view of a single screen deck.

Each screen deck includes a housing 43, see FIG. 5, of generally rectangular outline which mounts a screen 44 at the top. A ball-type screen cleaner designated generally at 45 is optionally provided below the screen to aid in preventing clogging, of a type known per se. The fines which pass through screen 44 fall through the ball cleaner and the lower ball supporting screen 46, and are collected on a bottom pan 47. The bottom pan is shaped to funnel the fines toward the center of the inner edge thereof, to a fines outlet. The fines outlet includes a sleeve or collar 48 that projects from screen housing 43 and through an opening 49 (see FIG. 3) in the vertical wall of fines chute 38. The over-the-screen or product material is discharged over the inner edge 50 of the screen deck into product chute 37, on either side of fines chute 38, see FIG. 3. Each of the screens in the banks may be similar, and in the embodiment illustrated the total screen area is 20 times (4×5) the area of each single screen. Thus a very large total screen area is present over a relatively small floor space.

Effective use of this large total screen area requires even splitting of the input flow coming from the distributor panels 27. The splitter structure for accomplishing this is best seen in FIGS. 2, 3 and 4, wherein it is designated generally at 55.

Distributor 55 comprises a removable assembly which is demountably secured to machine frame 15 at the outer end of the respective screen stack. It includes a back panel 56, a cover 57, left and right sides 58 and 59, and a top and bottom (see FIG. 3), between which a flow distribution chamber is defined. The distributor is secured to the machine by bolts which pass through edge flanges 62 of the distributor. As seen in FIGS. 2 and 3, back panel 56 abuts the outer ends 61 of the screens of the bank. Feed material from distributor panel 27 above falls as a curtain over panel outer edge 28, at a uniform rate along the panel edge, into the chamber between back panel 56 and cover 57 (the width of this chamber being essentially equal to the width of panel 27 and also to the width of the screens).

Figure 4:
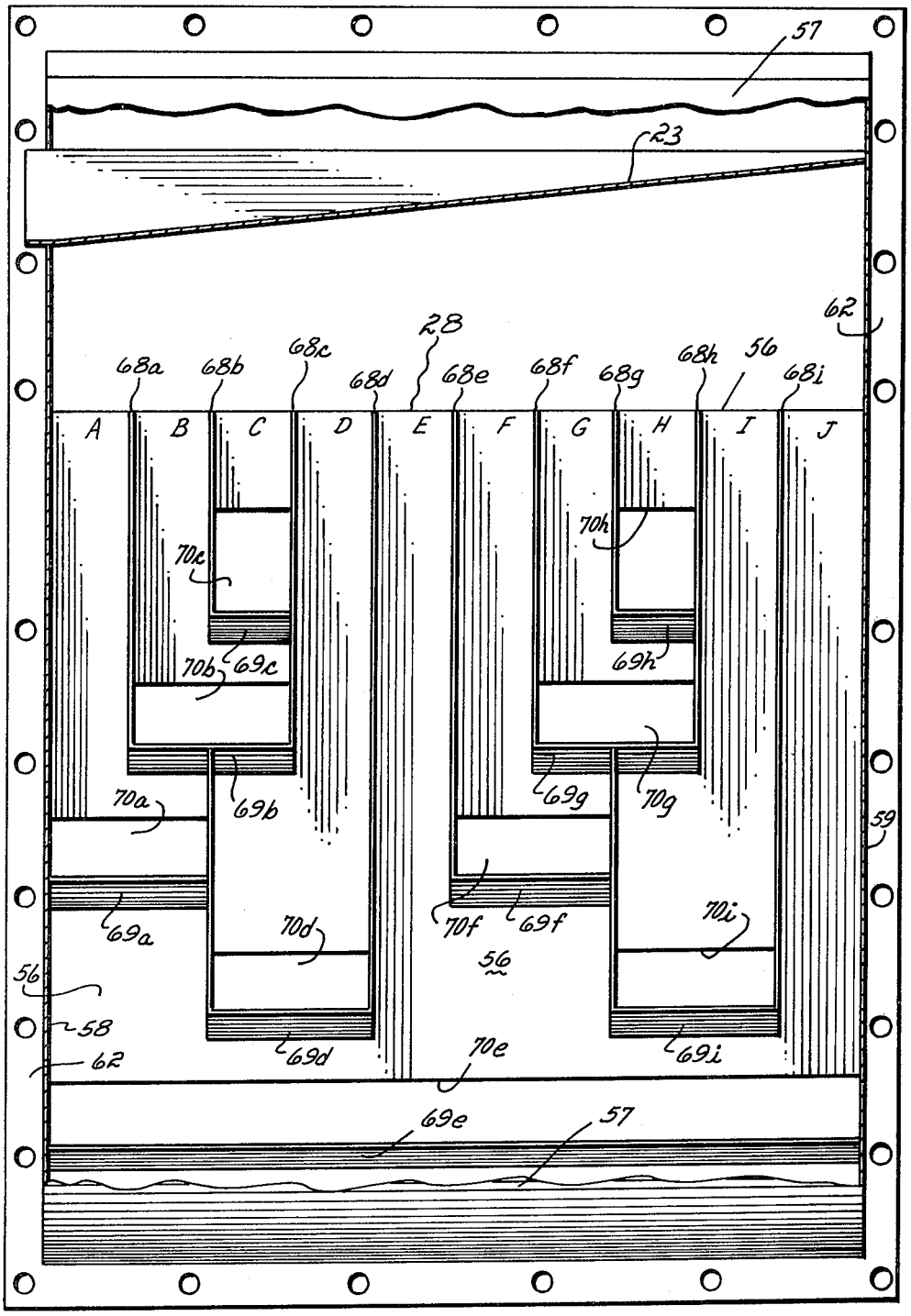
FIG. 4 is a vertical section taken on line 4—4 of FIG. 3, inside the cover of the distributor.

The curtain of falling particulate material is divided and confined in parallel but separate streams by a series of vertically oriented flow dividers designated at 68*a*–68*i* in FIG. 4. The dividers are of sheet metal and divide the distribution chamber between back panel 56 and cover 57, and together with the left and right sides 58 and 59 of the splitter they define a series of vertical flow channels of uniform area (as measured in a horizontal plane). There is at least one such channel to feed each screen; in the embodiment illustrated there are ten channels, designated A-J of equal width, two separate channels feeding each of the five screens 30–34. From FIG. 4 it will be apparent that once material falls over the distributor edge 28, it is immediately confined within a particular channel, between the adjacent dividers or sides which define that channel.

Each channel A-J leads downwardly to a chute 69*a*–*i* respectively which directs the particulate material from the channel onto the screen. Each chute slants inwardly and passes through an opening or window 70*a*–*i* in back panel 56, to open onto the screen 30–34 which that particular channel serves. Thus channel A leads downwardly to chute 69*a*, which in turn leads through window 70*a* onto screen 32, see FIG. 4. (Channel F also leads to this same screen, through its chute 69*f* and window 70*f*, FIG. 4.) Similarly, feed discharged over distributor panel edge 28 into channels B and G is discharged onto screen 31; material captured in channels C and H is fed onto screen 30; material in channels D and I is discharged onto screen 33, and the remaining material, captured in channels E and J, falls to the lowermost screen 34, onto which it is directed by chute 69*e* which runs across the entire width of the distributor, between sides 58 and 59 at the bottom thereof. Because the material is channelized throughout its entire fall from the panel edge 28, the gyratory motion of the machine does not alter the fractionation.

The vertical drop of material in each channel ends at its respective chute 69, and as seen in FIG. 4 there is a "dead space" immediately beneath each chute except the lowermost chute 69*e*. This dead space is utilized to provide a larger window for flow from an underlying chute. Each channel widens into the dead space under an adjacent chute. One of the dividers which defines each channel terminates at the respective chute; for example, divider 68*b* which defines the left side (as seen in FIG. 4) of channel C terminates at chute 69*c*, whereas the other divider 68*c* continues downwardly to the chute 69*b* of adjacent channel B. Every chute save the uppermost chutes 69*c* and 69*h*, extends laterally into dead space under the adjacent higher chute, and thus is wider than the particular channel that feeds it. Thus chute 69*b* has a width equal to the combined width of channel B which feeds it plus channel C which terminates immediately above it. This enables material falling in channel B to flow laterally or "fan out" over a wider distance than otherwise and thus to be discharged upon the screen through a wider window. The "extra width" of the chutes, save uppermost chutes 69*c* and *h*, enables such lateral flowout to take place before the material is discharged through the windows onto the screens, and thus to discharge onto a wider screen area.

As explained, the windows fed by the lower chutes, that is, all of the chutes save the two uppermost chutes 69*c* and *h*, are twice the width of the windows 70*c* and *h* of the uppermost chutes. Since there is no dead space over those two chutes, they are not widened laterally. In order to provide an equivalent area (although not an equivalent width) for flow, the uppermost windows 70*c* and *h* have twice the height of the other windows, and half the width. The lesser height and greater width of the lower windows minimizes the overall vertical height of the machine (FIG. 4).

It has been found that this lateral flow arrangement provides a substantially higher optimum flow capacity than would be the case if the screen entrance windows were of the same width as the channels which feed them. This can readily be demonstrated by blocking that portion of the channel windows and chutes which project under overlying chutes. Capacity would otherwise be reduced, and the machine would screen less effectively at high flow rates because the material would be discharged less uniformly onto the screens.

As previously mentioned, distributor 55 is detachably mounted as by bolts to machine frame 15. When it becomes necessary to change any of the screens, for example for replacement or to install a different size screen, the entire distributor 55 is demounted as a unit by removing the securing bolts, thereby making accessible all of the screen decks which can be slid out as drawers on the guides 42, 42. This is a distinct improvement over past machines which have required removal of the screens in sequence from the top down.

By reference to FIG. 2 it can be seen that when a deck is so removed, the snout or sleeve 48 by which it couples to fines chute 38 is withdrawn from the opening 49 in that chute and thereby decouples from it. This simple and automatic coupling and decoupling to the fines and product chutes greatly facilitates routine maintenance and screen changes.

It should be noted that, by reason of the paired arrangement of the banks, either "half" of the machine can be used separately. That is, by feeding only through feed chute 21, only banks 13 and 14 will screen. The pairs of banks can be fitted with differently sized screens, for screening one material on one side and (at a different time) another material on the other two banks. This is a substantial advantage in that it can eliminate the need to change screens.

As previously noted, the upper windows 70*c* and 70*h* (through which top screen 30 is fed) are narrower than the windows that feed the lower screens 31–34. Because of this narrowness, the feed streams through the upper windows are not as wide, when they enter onto the screen, as the streams through the lower windows. In order to increase the lateral width of the streams through the upper windows (or, for that matter, through any of the windows) to achieve a wider spread on the feed end of the screens, flow spreading means such as shown in FIG. 6 may optionally be provided.

Figure 6:
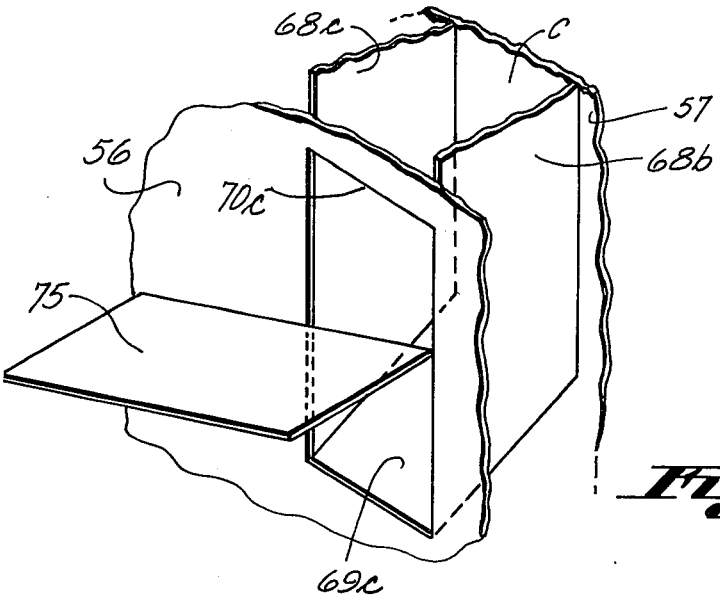
FIG. 6 is an enlarged perspective of a flow spreader which may be used in conjunction with the invention.

As shown in FIG. 6, a laterally projecting, downwardly slanting plate 75 is mounted to the distributor back panel 56, the panel projecting toward and over screen 30 on the opposite side of the back panel from the respective channel C. Plate 75 is positioned vertically approximately at the middle of the height of the window 70*c*, and projects laterally across the window and to the side of the window. In operation, the stream from channel C can pass through the full height of the window. That portion which passes through the window at a level below slanting panel 75 feeds directly onto screen 30, whereas that portion of the stream that passes through the window above plate 75 can slide laterally (to the left in FIG. 6), before it falls on the screen. This helps to increase the spread immediately as the stream is deposited on the screen. As mentioned, such flow spreaders may be used in connection with other windows as well, to serve other screens, although because of their greater width the lower windows will themselves provide larger feed areas than the uppermost windows.

Figure 7:
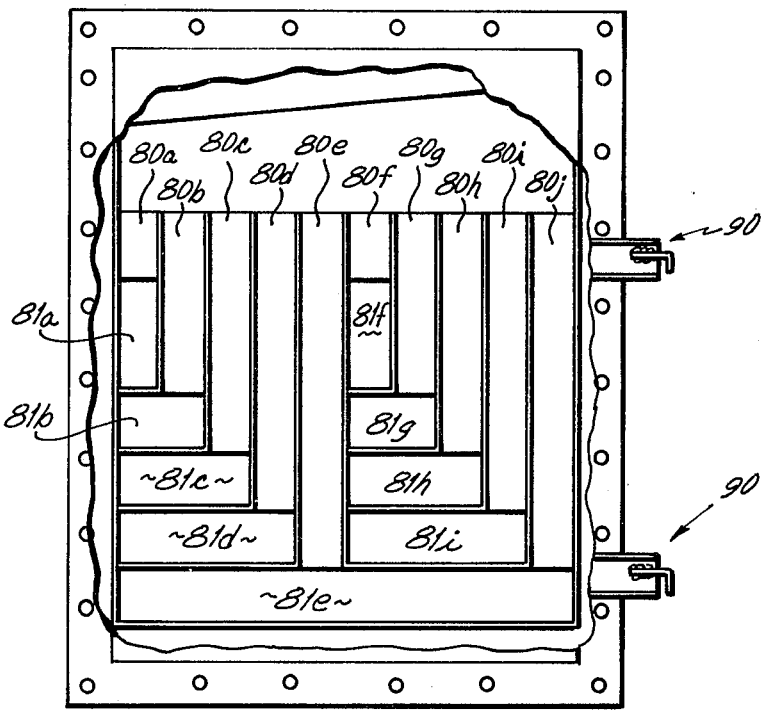
FIG. 7 is an elevation of an alternative embodiment of distributor panel, and also illustrates hinge means for swingably attaching the panel to the machine frame.

In the distributor embodiment shown in FIGS. 2 and 4 and described above, the chutes which feed screens 31, 32 and 33 (i.e., chutes 69*a*, 69*b*, 69*d*, 69*f*, 69*g*, and 69*i*) and the respective windows 70*a*, etc., are each twice the width of the chutes 69*c* and 69*h* which feed the top screen 30. An alternative embodiment is shown in FIG. 7, wherein progressively wider chutes and windows are provided; rather than having chutes of the same width, each successively lower screen in fed from a chute which is wider than the chute which feeds the screen above. In FIG. 7, topmost screen 30 (not shown) is fed by chutes 80*a* and 80*f*, through windows 81*a* and 81*f*; the second screen from the top, screen 31, is fed via chutes 80*b* and 80*g* through windows 81*b* and 81*g*; the third screen 32 is fed via chutes 80*c* and 80*h* through windows 81*c* and 81*h*; the fourth screen 33 is fed via chutes 80*d* and 80*i* via windows 81*d* and 81*i*; and the bottom screen 34 is fed by two chutes 80*e* and 80*j* which lead to a full width window 81*e*. The chutes are arranged in repetitive left-to-right sequence (in contrast to the first embodiment), and each chute projects under all of the higher chutes. The uppermost chutes and windows are "single width." The next chutes 81*b* and 81*g* (and the corresponding windows) are double width, as in the first embodiment. The chutes and windows which feed the third screen are triple width, window 81*c* extending in the blind area beneath double width chute 81*b*. The chutes and windows which feed the fourth screen are four times the width of window 81*a*, etc. Thus in this arrangement the flow areas through which material flows onto the first, second and fifth screens are the same as those of the first embodiment, but the third and fourth screens 32 and 33 are fed through wider areas.

In the first embodiment the distributor 55 is fully demountable from the machine frame 15, to permit removal or service of the "drawer-mounted" screens. It is alternatively contemplated that the distributor may be mounted to the machine frame by hinge means so that it can be swung open like a door, rather than demounted altogether. FIG. 7 shows hinging means at 90, 90 whereby the distributor panel is swingably attached to the machine frame.

Having described the invention, what is claimed is:

1. In a multiple deck screening machine wherein particulate material to be screened falls into a series of chutes which divide it into fractions and direct the respective fractions onto screens in a stack, a feed splitter comprising, a series of vertically extending dividers positioned in the path of the falling particulate material, the dividers defining channels between them, the dividers dividing the falling material into separate fractions as it falls into the respective channels, each channel leading downwardly to a separate chute which directs the respective fraction from the channel onto a screen of the stack, the chutes being at different vertical positions according to the vertical positions of the screens to which they lead, the lower chutes including portions extending laterally from their respective channels into the areas below upper chutes, to provide flow areas which are wider than the respective channels which feed them, thereby providing wider entrances onto the respective screens.

2. The feed splitter of claim 1 including a downwardly slanting distribution panel, means feeding the particulate material onto said panel, the panel having a lower edge overlying the channels so that the material falls over said lower edge of the panel as a curtain, into the channels.

3. The feed splitter of claim 1 further comprising a back panel and a cover defining a distribution chamber between them, the dividers and chutes mounted in said chamber between the said back panel and cover, said feed splitter comprising a unit which is removably attached to said machine, adjacent the screens.

4. The feed splitter of claim 3 wherein each chute connects to the respective screen through a window in said back panel.

5. The feed splitter of claim 1 wherein a frame removably mounts the screens, the screens having ends which are in vertical alignment, the feed splitter being removably mounted to said frame adjacent the screen ends, the screens being accessible for removal upon removal of the feed splitter from the frame.

6. The feed splitter of claim 5 wherein each screen is slidably received in said frame on guides which extend inwardly of the frame from said feed splitter, each screen being slidable out of said frame on said guide when said feed splitter is removed.

7. The feed splitter of claim 1 wherein each channel, except that one which leads to the uppermost chute, extends laterally below the chute of an adjacent channel, into space below the chute of the adjacent channel.

8. The feed splitter of claim 1 wherein each chute, except the uppermost chute, has a width which is at least twice the width of the uppermost chute.

9. The feed splitter of claim 1 wherein the lowermost chute extends across the full width of the screen to which it leads.

10. The feed splitter of claim 1, further wherein the machine has a drive which imparts a gyratory motion to the screens, having a lateral component of motion in the plane of the channels, said lateral component causing relative lateral movement of the dividers to the material as it falls in the channels, whereby the material is deflected off the diverters, each channel confining the respective fraction in it regardless of such deflection.

11. In a multiple deck screening machine wherein the particulate material to be screened falls into a series of chutes which divide it into fractions and direct the respective fractions onto parallel, vertically spaced apart screens, the improvement comprising, a sloping panel onto which the material is fed, said panel having an edge over which the material falls as a curtain, a series of vertically extending divider walls positioned immediately below said edge, said dividers defining channels between them which receive the material falling from said edge, said dividers dividing the curtain of falling material into separate fractions, each channel leading downwardly to a slanting chute which directs the respective fraction from the channel onto a screen, the lower chutes including portions extending laterally in the plane of the channels from their respective channels into areas below overlying upper chutes, to provide flow areas which are wider than the respective channels which feed them, thereby directing the material onto a wider area of the respective screen.

* * * * *